United States Patent [19]

Gerber et al.

[11] Patent Number: 4,665,794

[45] Date of Patent: May 19, 1987

[54] ARMOR AND A METHOD OF MANUFACTURING IT

[75] Inventors: Urs Gerber, Flurlingen; Erich Gerber, Schaffausen; Peter Hofer, Hofen; Erwin Fischer, Schaffhausen; Werther Lusuardi, Zurich; Walter Gysel; Roland Baggi, both of Schaffhausen; Eduard Rogg, Diessenhofen; Karl Gut, Benken, all of Switzerland

[73] Assignee: Georg Fischer Aktiengesellschaft, Schaffhausen, Switzerland

[21] Appl. No.: 557,177

[22] PCT Filed: Mar. 11, 1983

[86] PCT No.: PCT/CH83/00028

§ 371 Date: Nov. 10, 1983

§ 102(e) Date: Nov. 10, 1983

[87] PCT Pub. No.: WO83/03298

PCT Pub. Date: Sep. 29, 1983

[30] Foreign Application Priority Data

Mar. 12, 1982 [CH] Switzerland ..... 534/82

[51] Int. Cl.[4] ..... F41H 5/02

[52] U.S. Cl. ..... 89/36.02; 109/84; 428/911

[58] Field of Search ..... 89/36.02; 109/78, 80, 109/82, 83, 84; 428/911

[56] References Cited

U.S. PATENT DOCUMENTS

| | | | |
|---|---|---|---|
| 952,877 | 3/1910 | Cowper-Coles | 89/36.02 |
| 3,431,818 | 3/1969 | King | 89/36.02 |
| 3,523,057 | 8/1970 | Buck | 89/36.02 |
| 3,573,150 | 3/1971 | Broutman | 161/55 |
| 3,616,115 | 10/1971 | Klimmek | 89/36.02 |
| 3,705,558 | 12/1972 | McDougal et al. | 89/36.02 |
| 3,826,172 | 7/1974 | Dawson | 89/36.02 |
| 4,125,053 | 11/1978 | Lasker | 89/36.02 |
| 4,179,979 | 12/1979 | Cook | 89/36.02 |

FOREIGN PATENT DOCUMENTS

| | | | |
|---|---|---|---|
| 838316 | 5/1976 | Belgium . | |
| 0041271 | 12/1981 | European Pat. Off. . | |
| 2031658 | 5/1972 | Fed. Rep. of Germany . | |
| 2759193 | 7/1979 | Fed. Rep. of Germany | 89/36.02 |
| 2344222 | 6/1984 | Fed. Rep. of Germany . | |
| 1403518 | 5/1965 | France . | |

*Primary Examiner*—Deborah L. Kyle
*Assistant Examiner*—Ted L. Parr
*Attorney, Agent, or Firm*—Roylance, Abrams, Berdo & Goodman

[57] ABSTRACT

An armour plate (1) comprises cavities (2), which are arranged with a plurality of packing bodies (3) in an irregular or regular shape relative to each other. The packing bodies are hollow-bodied, preferably spherical or tubular, and consist of a non-metallic material, preferably glass or ceramic. The interspaces between the packing bodies are filled out with a plastics, preferably a foam made for example of polyurethane.

29 Claims, 9 Drawing Figures

Fig.1
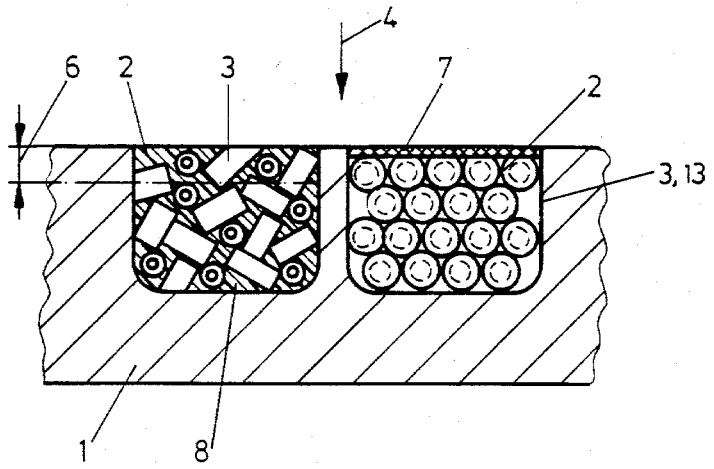
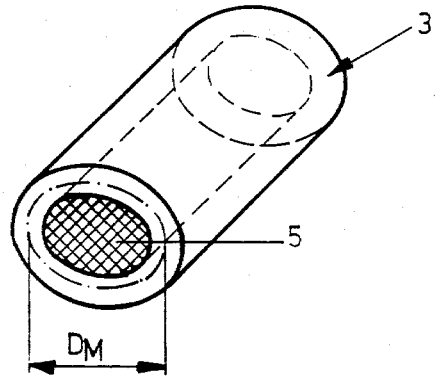
Fig.2
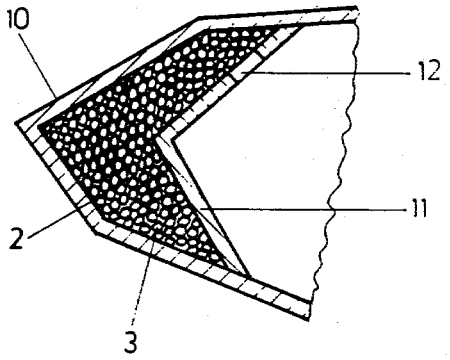
Fig.3

ARMOR AND A METHOD OF MANUFACTURING IT

The invention relates to armor as characterised in the preamble of claim 1 and a method of manufacturing it.

Armor of the above type is known, but its protective effect is insufficient particularly against hollow-charge projectiles.

It is the aim of the present invention to create armor of the above type, which, using simple means, ensures a higher degree of protection particularly against hollow-charge projectiles, security against multiple bombardment being intended to be improved specifically.

This is achieved according to the invention by the features given in the characterising part of claim 1.

Further advantageous developments are characterised in the dependent claims.

By arranging a plurality of filler elements of differing or uniform sizes and/or shapes in an irregular or regular orientation relative to each other, an armor is produced with a material density and orientation changing rapidly in cross-section. With such sudden changes in density and structure, the effect of the heat ray resulting from hollow-charge projectiles reduces quickly, whereby the protective capacity is increased. Bedding the filler elements into a plastic increases the safety against multiple bombardment.

The invention is shown and described below with the use of several embodiments in the attached drawings.

Figure 4:
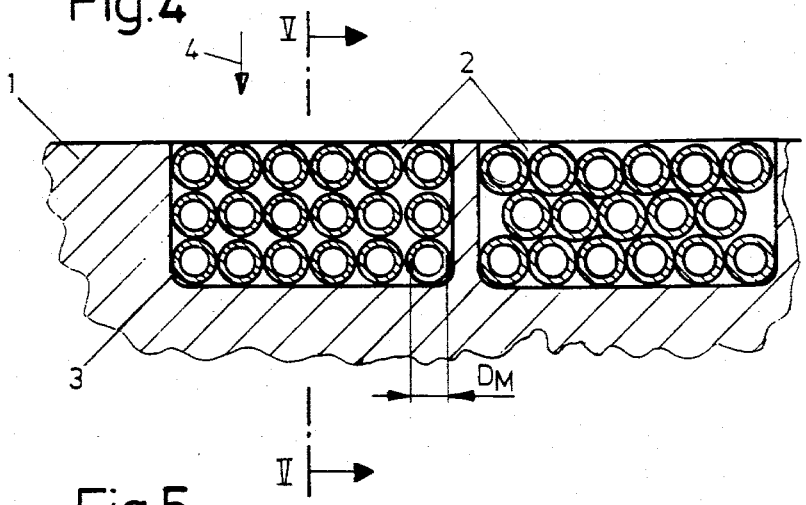
Figure 5:
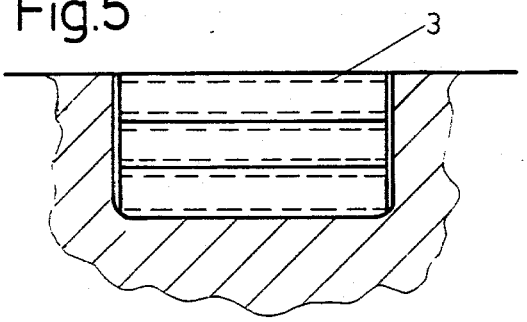
Figure 6:
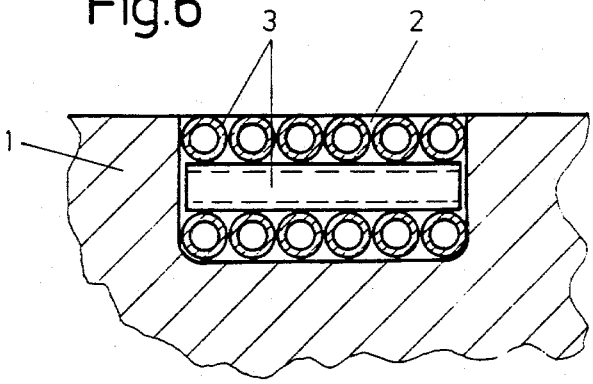
Figure 7:
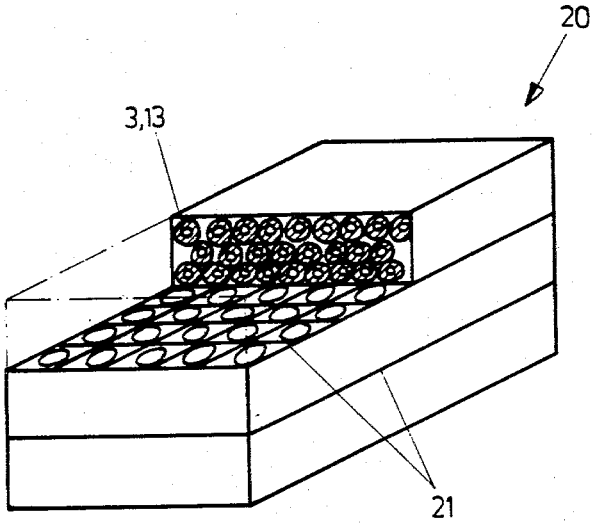
Figure 8:
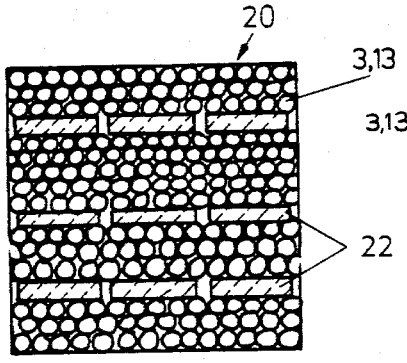
Figure 9:
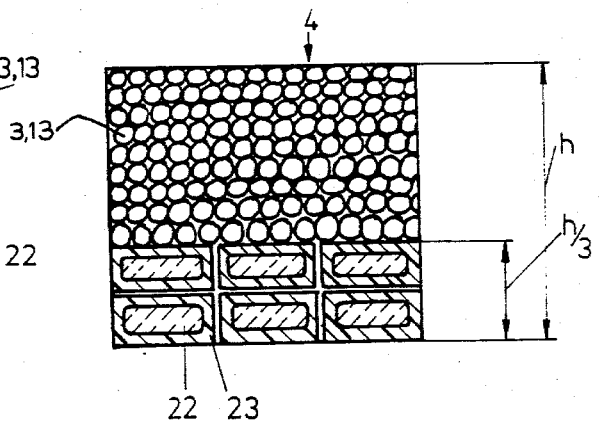

There are shown:

FIG. 1 a first embodiment of an armor in part-cross-section,

FIG. 2 a perspective view of a filler element,

FIG. 3 a second embodiment of this invention with spherical filler elements, FIG. 4 a third embodiment of this invention, FIG. 5 a section along line V—V in FIG. 4, FIG. 6 a fourth embodiment of this invention, FIG. 7 a block consisting of filler elements and plastics, FIG. 8 a variation of the block shown in FIG. 7 in cross-section, FIG. 9 a further variation according to FIG. 8.

According to FIG. 1, spaces 2, which have at least one opening for pouring in, but are preferably accessible from the entire outside surface, are found in even or uneven distribution in an armor plate 1, consisting of armored steel, or an armor-plated element, also referred to as a module.

Hollow filler elements 3 are advantageously arranged in spaces 2 by random pouring in. Filler elements 3 are of tubular shape, as can be seen from FIG. 2 and the left of FIG. 1, and preferably are of glass or ceramic. As can be seen on the right of FIG. 1, the filler elements can also be hollow spheres, and combinations of different shapes and/or different sizes are also possible.

When filler elements 3 have been filled into the respective space 2, the remaining empty spaces can then be filled with a plastic 8, preferably a foam, such as a polyurethane foam. The filler elements can also be connected, bonded or have a coating poured on before or after being poured in with an organic or inorganic binder such as monoalumiphosphate binder or a curable plastic, which, once hardened, holds the individual filler elements together. In the case of ceramic filler elements, the individual elements can also be bound together by sintering.

The ratio of the volume $V_H$ of the space to the volume $V_F$ of the individual filler element should be greater than 100, and preferably greater than 250. Filler elements with an average diameter $D_M$ of at least 3 mm and at the most 15 mm give the desired volume ratios for an advantageous space size.

The tubular pieces shown in FIG. 2 have an external diameter of 10 mm, a length of 10 mm and a bore of 8 mm.

Some of the filler elements having a space can advantageously be filled with an explosive 5, the percentage of filler elements 3 provided with explosive in one space 2 amounting to 30% at the most, but preferably to only 1%. The filler elements provided with explosive are then arranged on the side of the space facing the main exposure, shown by the arrow 4, in a layer or zone 6 whose size corresponds to the percentage.

The explosive used advantageously has a detonation speed of at least 6700 m/sec., preferably of more than 9000 m/sec. The explosive can also be arranged on the described side of the space in the form of an explosive sheet 7 (see FIG. 1).

Nitramine, particularly nitroguanidine, cyclotrimethylene trinitramine and cyclotetramethylene tetranitramine have proved to be particularly suitable as explosives.

The use of filler elements with explosive or an explosive sheet ensures that the hollow-charge projectile beam is damaged by a counter explosion, or the rearmost part is blasted off, which increases the protective effect.

The spaces can be provided on the outside as well as on the inside of an armor plate, or respectively of a plate element, and be covered with a plate.

The right of FIG. 1 and respectively FIG. 3 show an embodiment in which the filler elements 3 are hollow spheres 13 or have the form of a sphere of respectively a hollow sphere. Each space 2 can be filled with filler elements 3 of uniform or differing sizes, and of the same or different nonmetallic material. The hollow spheres preferably consist of ceramic—particularly corundum—, but they can also be manufactured from glass or another nonmetallic material. The hollow spheres or filler elements can be arranged in regular layers in the spaces, or they can be arranged in an irregular orientation relative to each other in the space produced by pouring in with as great as possible a packing density. The remaining spaces are filled with a curable two-component plastic such as a polyurethane foam or an epoxide. The outside diameter of the spheres used advantageously lies somewhere between 3 and 15 mm. In FIG. 3, space 2 is formed by an outside armored plate 10 and an inside armored plate 11, e.g. of an armored vehicle, and the preferably hollow-spherical filler element 3 is poured in through an aperture 12 either together with the plastics or one after the other.

In the embodiments according to FIGS. 4 to 6, tubular filler elements 3 are arranged in spaces 2 in an orderly manner. Filler elements 3 preferably are of glass or ceramic. Other shapes of filler element, having a space and being insertable in regular orientation and other materials can be used.

Tubular filler elements 3 are advantageously laid in several layers on top of each other in an orderly fashion in each space 2 so that their longitudinal axes are at right angles to a direction 4 perpendicular to the main exposed side.

According to FIG. 4, the tubes 3 are arranged in the same direction in all layers, and according to FIG. 6, the individual layers are arranged transversely to each other in an alternate fashion. The arrangement according to the right-hand side of FIG. 4 generally gives better use of space compared to the arrangement shown on the left of FIG. 4.

Each tube 3 is slightly shorter in this case than the length or breadth of a space 2. The spaces are preferably square in plan, so that tubes of the same length can be used for both methods of embedding. The ratio of length to diameter of tubular filler elements 3 should be somewhere between 6:1 and 12:1, and preferably 10:1. The average diameter $D_M$ of the tubes is greater than 7 mm, and preferably greater than 8 mm.

The ratio of the volume of a space $V_H$ to the volume of pure material of all the embedded packing bodies $V_{FT}$ should be greater than 2.

For an embodiment using glass tubes with an outside diameter of 10 mm, an inside diameter of 8 mm, and a length of 100 mm, the volume of glass alone is 40%, the volume of air in the tubes 45% and the volume of air around the tubes 15% of the whole space volume, which gives a ratio of $V_H/V_{FT}=2.5$.

With such ratios, a good protective effect is achieved for as low as possible a weight of the armor.

When filler elements 3 have been poured into space 2, the remaining spaces can then, as already described, be filled with a two-component plastic, preferably with a foam, made for example of polyurethane, or can also be bonded with or have poured over them an inorganic or organic binder before or after pouring in, which, once hardened, holds the individual filler elements together.

The tubular filler elements 3 can be bound together by melting the material at the points of contact by suitable control of the temperature, i.e., by heating to a certain temperature for a certain length of time. This can be done in a suitable temperature-resistant mold before the filler elements are poured into spaces, so that the filler elements can be embedded in the space as a unit. The temperature control can then be selected so that the tube collapses partially, whereby the volume proportion of the filler element material can be varied. The proportion of filler element material—preferably the proportion of glass—increases with this type of change in the shape of the tubes, whereby the volume ratio $V_H/V_{FT}$ can also fall below 2.

Producing the space-filling with filler elements and a two-component plastic can be carried out in a different manner.

Variaton A: Mix filler elements, first component and wetting agent and admix second component shortly before pouring into the space or into a mold.

Variation B: Mix both components and filler elements and then pour in.

Variation C: Pour in the filler elements, pour in the polyurethane mixture under pressure or gravitational force. These variations can also be used when the filler elements are in a position orientated towards each other.

If, according to FIG. 7, rigid, cured blocks 20 of filler elements 3 and plastic are to be manufactured for pouring into the spaces or for piling on plates, these can be sheathed with a wire mesh or expanded metal 21. Such blocks are made in a mold, and the sheathing 21 is fixed first in the mold, and filler elements 3 and plastic are then filled in according to one of the processes A, B, or C.

According to FIG. 8, block 20 has several layers of plate-like elements 22, which consist preferably of ceramic or glass, between filler elements 3—preferably hollow spheres 13.

Another embodiment of a block 21 is shown in FIG. 9, where plate-like elements 22 are arranged in several layers on the side of the block opposite the exposed side, and take up approximately ⅓ of the heighth of the block. Plate-like elements 22 are advantageously provided with a sheating 23 of plastic such as polyurethane or an elastomer.

Such blocks can also be used as modules in armor having a combined protective effect against various types of projectiles, these modules forming in particular the protection against hollow charges.

The spaces or the cured blocks can be arranged both on the exterior and the interior of an armor plate, or a plate element, and can be covered with a plate.

What is important for increasing the security against multiple bombardment is optimizing the two-component plastic used, preferably a polyurethane.

This optimizing is carried out in respect of strength, toughness, hardness, processibility, and/or by suitable sheating or cross-linking.

Of course, the type and arrangement of filler elements, the plastic used and the method of manufacturing can be combined in different ways in the described embodiments, whereby further embodiments are produced within the framework of the invention.

In particular, a plurality of layers can be provided, comprising filler elements of differing sizes.

In a modification of FIG. 8, for example, the layers with plate-like elements 22 can be provided with filler elements 3, 13 having a diameter which is considerably greater compared to the other filler elements. The difference in diameter of the filler elements used in the two different layer should preferably lie in a ratio of 1:3 to 1:6.

We claim:

1. Armor for protection against hollow-charge projectiles, comprising:

a member with a cavity having a volume $V_H$;

a plurality of nonmetallic, hollow, spherical filler elements densely packed within said cavity, said elements having an individual volume $V_F$ and a total pure solid material volume $V_{FT}$, the ratio of $V_H/V_{FT}$ being greater than 2; and a two-component polyurethane foam plastic which at least partially fills space in said cavity unoccupied by said elements.

2. The armor of claim 1, wherein said filler elements comprise a material selected from the group consisting of glass and ceramic.

3. The armor of claim 2, wherein said material is ceramic.

4. The armor of claim 3, wherein said ceramic is corundum.

5. The armor of claim 1, wherein said member is armor plate.

6. The armor of claim 1, wherein said member is an armor plate element.

7. The armor of claim 1, wherein said plastic tightly binds said filler elements to form a self-contained block.

8. The armor of claim 1, wherein said hollow, spherical filler elements have an outside diameter between 3 mm and 15 mm.

9. The armor of claim 1, wherein said elements are arranged within said cavity with centers thereof in adjacent layers being laterally offset to achieve the greatest possible density.

10. The armor of claim 1, wherein the ratio of $V_H/V_F$ is greater than 100.

11. The armor of claim 1, wherein the ratio of $V_H/V_F$ is greater than 250.

12. The armor of claim 1, wherein the ratio of $V_H/V_{FT}$ is 2.5.

13. The armor of claim 1 wherein sheathing is coupled to said filler elements.

14. The armor of claim 13, wherein said sheathing is selected from the group consisting of wire mesh and expanded metal.

15. The armor of claim 13, wherein said sheathing is embedded between said filler elements.

16. The armor of claim 1 wherein at least one layer of nonmetallic members is adjacent to said filler elements, said nonmetallic member being of a different size than said filler elements.

17. The armor of claim 16, wherein said nonmetallic member is plate-shaped.

18. The armor of claim 17, wherein said nonmetallic member comprises a material selected from the group consisting of glass and ceramic.

19. The armor of claim 18, wherein said nonmetallic member is sheathed.

20. The armor of claim 19, wherein said sheath comprises a material selected from the group consisting of plastic and elastomer.

21. The armor of claim 17, wherein said at least one layer is positioned on the side of the cavity opposite the side of said armor facing main exposure to said hollow-change projectiles, and said at least one layer comprises about 33% of the total thickness of said armor.

22. The armor of claim 1 wherein spherical explosive-filled elements are housed in said cavity.

23. The armor of claim 22, wherein said explosive-filled elements comprise between 0% and 30% of the combined total of said hollow elements and said explosive-filled elements.

24. The armor of claim 23, wherein said explosive-filled elements comprise between 0% and 1% of said combined total.

25. The armor of claim 23, wherein said explosive-filled elements are located on the side of the cavity facing main exposure to the hollow-charge projectiles.

26. The armor of claim 1, further comprising an explosive sheet located on the side of the cavity facing main exposure to the hollow-charge projectiles.

27. An apparatus for protection against both hollow-charge projectiles and non-hollow-charge projectiles, comprising:

a first armor for protection against hollow-charge projectiles, said first armor including:

a member with a cavity having a volume $V_H$, a plurality of nonmetallic, hollow, spherical filler elements densely packed within said cavity, said elements having an individual volume $V_T$ and a total pure solid material volume $V_{FT}$, the ratio of $V_H/V_{FT}$ being greater than 2, and a two-component polyurethane foam plastic, which at least partially fills space in said cavity unoccupied by said elements; and a second armor coupled to said first armor, said second armor having a means for providing protective effect against non-hollow-charge projectiles.

28. Armor for protection against hollow-charge projectiles comprising:

a member with a cavity having a volume $V_H$; and a plurality of nonmetallic, hollow, spherical filler elements densely packed within said cavity, said elements having an individual volume $V_F$ and a total solid pure material volume $V_{FT}$, the ratio of $V_H/V_{FT}$ being greater than 2.

29. The armor of claim 28 wherein a binder, at least partially fills space in said cavity unoccupied by said elements.

* * * * *